United States Patent [19]

Franzini et al.

[11] Patent Number: 4,704,729

[45] Date of Patent: Nov. 3, 1987

[54] SINGLE ACOUSTIC BOX WITH SPATIAL EFFECT FOR STEREOPHONIC MUSICAL REPRODUCTION SYSTEMS

[75] Inventors: Angelo Franzini; Eric Fricker, both of Milan, Italy

[73] Assignee: Fricker France, Milan, Italy

[21] Appl. No.: 803,107

[22] Filed: Nov. 27, 1985

[30] Foreign Application Priority Data

Nov. 30, 1984 [IT] Italy ..... 23959/84[U]

[51] Int. Cl.[4] ..... H04R 5/00

[52] U.S. Cl. ..... 381/24; 381/89

[58] Field of Search ..... 381/24, 88, 89

[56] References Cited

U.S. PATENT DOCUMENTS

| | | | |
|---|---|---|---|
| 2,768,702 | 10/1956 | Lowry | 381/89 |
| 3,054,856 | 9/1962 | Arany | 381/89 |
| 3,688,864 | 9/1972 | Guss | 381/89 |
| 4,326,099 | 4/1982 | Maille | 381/24 |
| 4,528,691 | 7/1985 | Edwards | 381/89 |

*Primary Examiner*—Forester W. Isen

*Attorney, Agent, or Firm*—Karl F. Ross; Herbert Dubno

[57] ABSTRACT

The single acoustic box with spatial effect for stereophonic musical reproduction systems, according to the invention, consists of an outer shell having at the top a loudspeaker for low-frequency sounds and on the lateral walls at least two loudspeakers for medium- and high-frequency sounds, positioned opposite to each other, and is equipped with a separating circuit having two inputs connectable to an amplifier of a stereophonic musical reproduction system and several outputs for low-frequency signals, unified and connected to the loudspeaker for low-frequency sounds and for high-frequency signals, divided between the two stereophonic reproduction channels, connected to two or more loudspeakers for medium - and high frequencies.

The spatial effect is perceived by the listener due to the multiple reflections of the acoustic waves against the walls of the installation site.

2 Claims, 3 Drawing Figures

SINGLE ACOUSTIC BOX WITH SPATIAL EFFECT FOR STEREOPHONIC MUSICAL REPRODUCTION SYSTEMS

The recording and reproduction of music so that it comes close as possible to the original, requires a reconstitution of the acoustic conditions existing at the recording site and therefore requires stereophonic devices, which record on separate channels the musical signals coming from different areas and reproduce these signals through separate loudspeakers situated far from each other, so that the listener will have the impression of being in the same ambiance in which the music has been recorded.

For this purpose, the musical reproduction systems now in use have at least two acoustic enclosures having several loudspeakers adjusted to cover the frequency range of the reproduction, fed by an amplifier with the signals for the two separate channels (right and left) in which the recording usually takes place; these enclosures however have to be positioned far apart and oriented so that the sounds emitted by both reach the listener, thus permitting optimal listening.

This often creates problems as to the arrangement and the space in the audition site, since the right placement of such units has to be found.

OBJECT OF THE INVENTION

It is an object of the invention to create the possibility of musical reproduction with spatial effect by means of a single acoustic unit or assembly, which can be much easier positioned at the audition site.

SUMMARY OF THE INVENTION

This object is obtained with the present invention, which provides a single acoustic enclosure, box or support with spatial effect for stereophonic musical reproduction systems, consisting of an outer shell with acoustical damping properties, having at the top at least one loudspeaker for low-frequency sounds and on the lateral walls, located opposite to each other, at least two loudspeakers for medium-frequency and high-frequency sounds. The assembly is provided with a separating circuit having two inputs for connection to an amplifier and several outputs, two of which carry respectively the medium-frequency and high-frequency signals relating to the two separate channels of the stereophonic emission and others of which carry the low-frequency signals. The outputs with low-frequency signals are connected to the mentioned low-frequency loudspeaker or loudspeakers, while the high-frequency outputs, divided between the two stereophonic channels are sent to the two mentioned loudspeakers for medium frequencies and high frequencies.

In order to provide strong sound emission, two low-frequency loudspeakers can be used, one of which is mounted turned upwards on the top of the outer shell and the other facing the first one, turned downwardly. The separating circuit feeds the first of the two loudspeakers with a signal consisting of the low-frequency emissions from one of the two channels exiting from the mentioned stereophonic amplifier and the second one of the mentioned loudspeakers with signals consisting of the low-frequency emissions of the other channel exiting the mentioned stereophonic amplifier, with reverse polarity. Alternatively, a single low-frequency loudspeaker having a power equivalent to the sum of the powers required of the low-frequency signals of each of the two channels of stereophonic reproduction.

The loudspeakers for medium- and high frequencies can be rigidly bolted to the box in pairs, in diametrically opposed locations, or, even more conveniently the loudspeakers for the medium- and high frequencies can be mounted on the shell by means of oppositely extending supports which can be oriented in vertical and horizontal direction.

BRIEF DESCRIPTION OF THE DRAWING

The major details will be apparent from the following description with reference to the accompanying drawing, in which.

SPECIFIC DESCRIPTION

Figure 1:
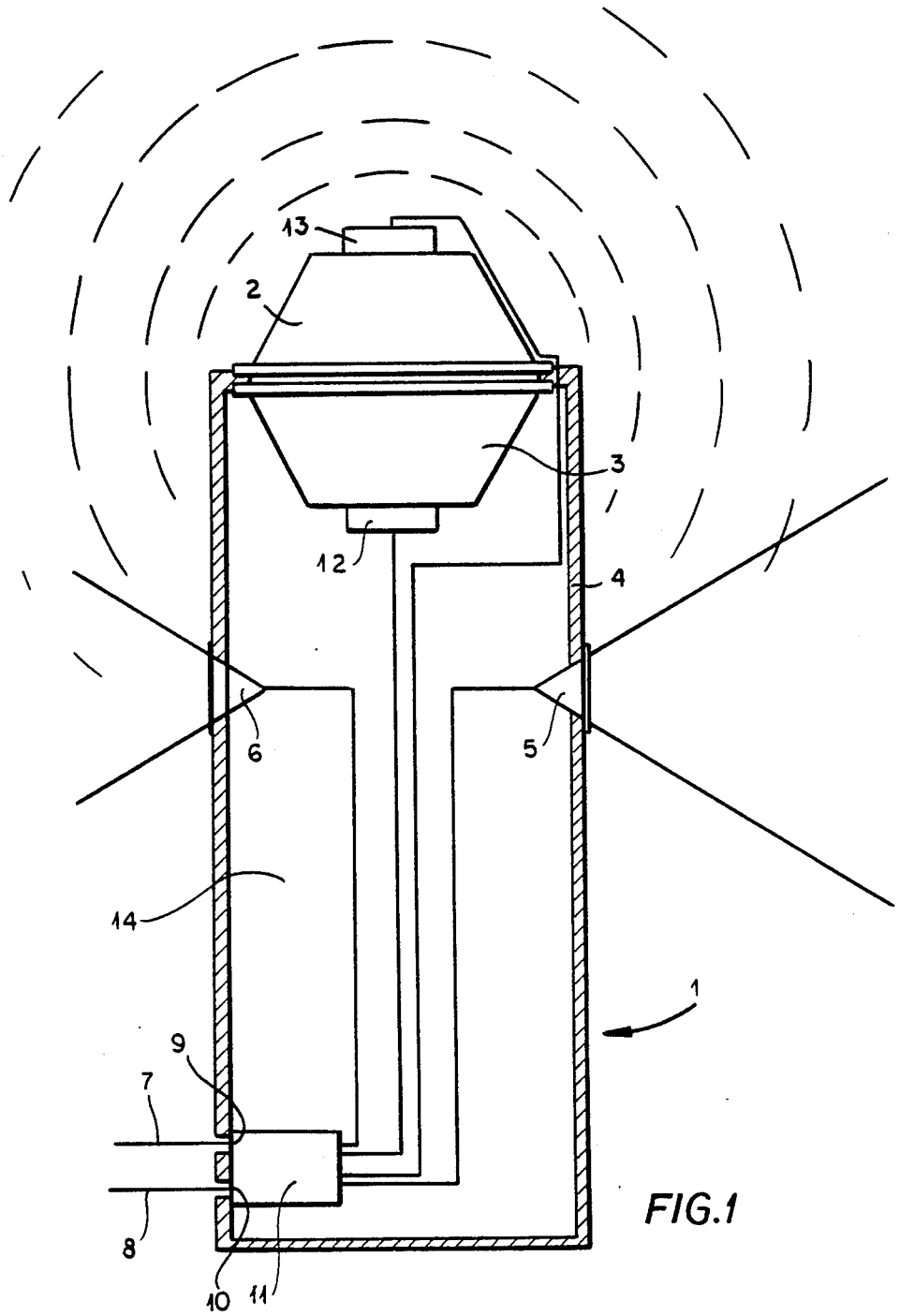
FIG. 1 is a sectional view of the acoustic box according to the invention.

As shown in FIG. 1, an acoustic box according to the present invention consists of an outer shell 1, made of wood or other materials having good acoustic properties, carrying on top a pair of loudspeakers for low frequencies 2, 3 facing each other. On the lateral walls 4, two loudspeakers for medium- and high frequencies 5, 6 are mounted diametrically opposite to each other.

The feeding lines 7, 8, coming from the amplifier and corresponding to the separate channels of the stereophonic reproduction system are connected to two inputs 9, 10 of a frequency-separating circuit 11, which sends separately the medium frequency and high frequency signals to the two loudspeakers 5, 6. The non-directional low-frequency signals are directly sent to the electromagnet 12 of the loudspeaker 3 and with reverse polarity, to the electromagnet 13 of the loudspeaker 2.

The vibrations emitted forwards and towards the outside of the loudspeaker 3 are in phase-concordance with the ones emitted towards the rear and the outside by the loudspeaker 2, because it is fed with reverse polarity relative to the polarity of the loudspeaker 2 so that the vibrations are summed, generating an acoustic signal substantially double in strength by comparison with one speaker.

Figure 3:
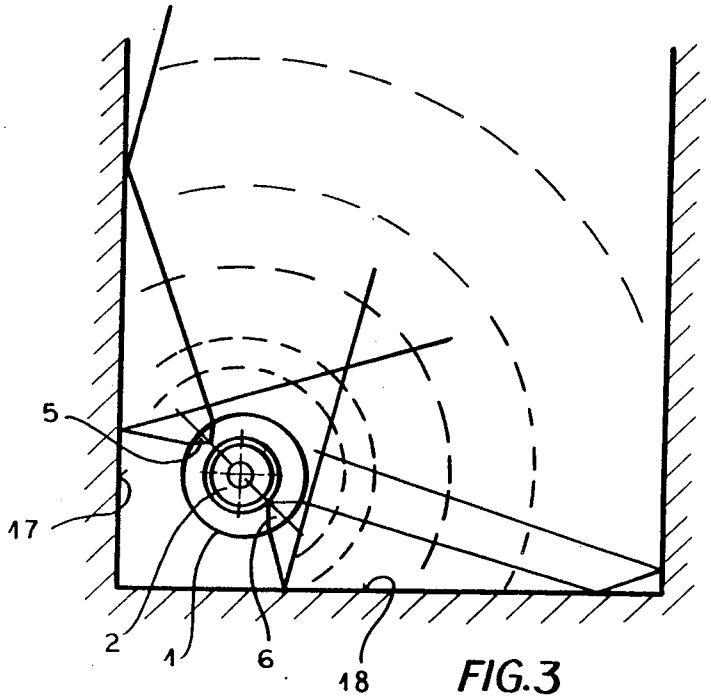
FIG. 3 is a schematic plan view of a possible installation of an acoustic box according to the invention.

Such a sound emission is substantially non-directional and therefore propagates in the form concentric spherical wavefronts, as shown in broken lines in FIGS. 1, 3, with partial exclusion of the lower area of the loudspeakers, and thus avoiding, or at least reducing substantially the undesired reflections against the floor.

The loudspeakers 5, 6 receive separately the signals corresponding to the two stereophonic channels and have a distinctly directional emission, basically limited to a cone with a reduced opening angle, as shown in FIGS. 1, 3. The emission is reflected by the walls of the site in which the acoustic box is located and is spread from there over a large area wherein the signals corresponding to the two stereophonic channels are perceived, with a spatial sound effect, as is shown schematically in FIG. 3.

Figure 2:
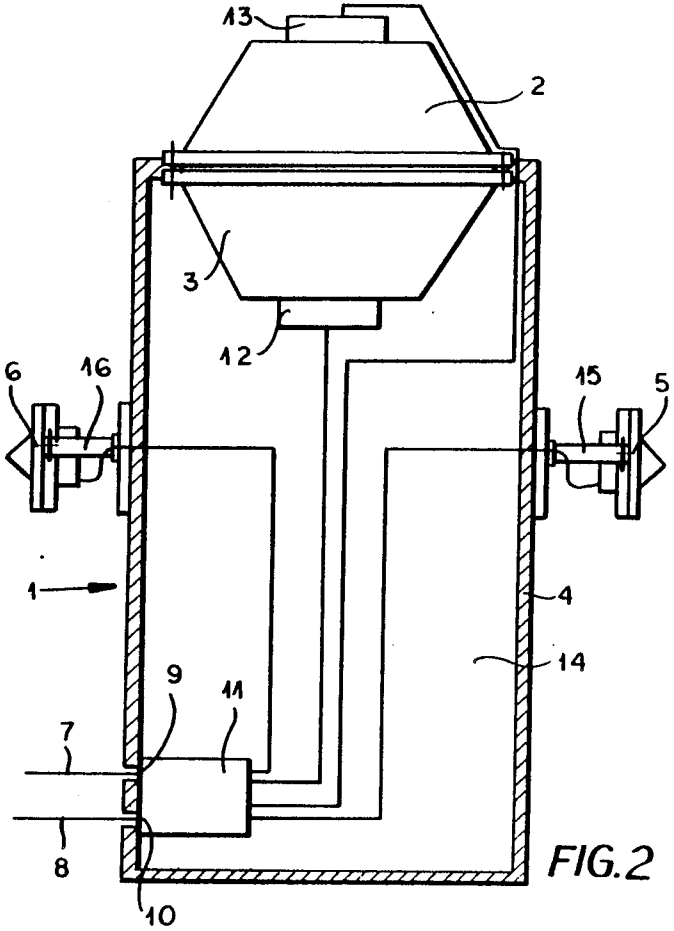
FIG. 2 is a sectional view of another embodiment of the acoustic box with orientable loudspeakers for medium frequency and high frequency.

FIG. 2 shows that the loudspeakers for medium- and high frequencies 5,6 can be provided with supports 15, 16 orientable either in vertical direction or in a horizontal plane; this way it is possible to select the best emission direction for each loudspeaker, depending on the acoustic characteristics of the site at which it is installed and on its position therein.

As schematically shown in FIG. 3, a possible location of the of the box can be in the proximity of a corner formed by two converging walls 17, 18, toward which the loudspeakers 5,6 are oriented, in a manner to generate sound reflections which will provide stereophonic listening even reach an area within the range of both sound reproduction channels in the proximity of the acoustic box.

The acoustic box according to the invention can be directly connected to the output of a stereophonic amplifier, without other interface elements, comprising the same number and type of speakers as the two traditional acoustic boxes.

Instead of the loudspeakers 2, 3, opposite to each other and fed with signals of reverse polarity it is also possible to use one single speaker, with double sound power or otherwise to couple the electromagnets of two loudspeakers, in this case with concording feeding, with a single emission trunk turned towards the interior or the exterior of the container.

For an optimal reproduction of medium- and high-frequency sounds, the use of more than two pairs of speakers for such frequencies can be proposed, mounted on the sides of the box, opposite to each other.

A convenient embodiment of the box according to the invention provides, as shown in FIG. 3, that the outer shell 1 be of a cylindrical shape, having at the top the loudspeakers 2,3 and the speakers 5, 6 affixed to the lateral surface, this allowing the largest possibilities for the orientation of the box for the best sound reproduction. The invention therefore makes it possible to obtain a spatial sound effect with the use of a single acoustic box, with consistent advantages from the point of view of the arrangement on site, where it does not have to be in a fixed location, such as is the case with the traditional boxes, due to the necessity to insure the arrangement in well established positions of the stereophonic acoustic boxes mentioned above.

We claim:

1. A speaker assembly for spatial-effect sound reproduction which comprises:

a shell having an upwardly open upper end and lateral wall means, and forming a loudspeaker support;

an upwardly turned first low-frequency loudspeaker mounted in said upper end of said support;

a downwardly turned second low-frequency loudspeaker disposed directly above and in contact with said first low-frequency loudspeaker;

at least one high-frequency loudspeaker mounted on said lateral wall means below said low-frequency loudspeakers;

at least one medium-frequency loudspeaker mounted on said lateral wall means below said low-frequency speakers at a location opposite said high-frequency loudspeaker;

a separating circuit received in said shell and having inputs connectable to two stereophonic channels of an amplifier, at least one low-frequency nondirectional output of a first polarity, at least one low-frequency nondirectional output corresponding to said nondirectional output of said first polarity but of opposite polarity, a directional medium-frequency output, and a directional high-frequency output; and means in said shell for connecting:

said low-frequency nondirectional output of a first polarity to one of said low-frequency loudspeakers, said low-frequency nondirectional output of said opposite polarity to the other of said low-frequency speakers, said directional medium-frequency output to said medium-frequency loudspeaker, and said directional high-frequency output to said high-frequency loudspeaker.

2. The speaker assembly defined in claim 1 wherein each of said loudspeakers mounted on said lateral wall means below said low-frequency loudspeakers is provided with a support element carrying same and orientable selectively in vertical and horizontal directions.

* * * * *